United States Patent [19]

Cawley et al.

[11] Patent Number: 5,018,586

[45] Date of Patent: May 28, 1991

[54] FIRE SUPPRESSION SYSTEM FOR A DECORATIVE TREE

[76] Inventors: Dennis Cawley; Richard Cawley, both of 101 Access Rd., Norwood, Mass. 02062

[21] Appl. No.: 471,215

[22] Filed: Jan. 26, 1990

[51] Int. Cl.[5] ..... A62C 37/08

[52] U.S. Cl. ..... 169/56; 169/61; 169/37

[58] Field of Search ..... 169/54, 56, 57, 58, 169/59, 60, 61, 5, 19, 26, 37

[56] References Cited

U.S. PATENT DOCUMENTS

| | | | |
|---|---|---|---|
| 1,368,055 | 2/1921 | Reznicek | 169/37 |
| 1,485,754 | 3/1924 | Albini | 169/54 |
| 2,522,020 | 9/1950 | Deyo | 169/54 |
| 2,871,952 | 2/1959 | Doak | 169/37 |
| 3,171,493 | 3/1965 | Barr | 169/37 |
| 3,198,258 | 8/1965 | Werner | 169/37 |
| 3,653,443 | 4/1972 | Dockery | 169/61 |
| 4,276,393 | 7/1981 | Atack | 169/60 |
| 4,351,393 | 9/1982 | Tyree | 169/37 |

*Primary Examiner*—Sherman D. Basinger
*Assistant Examiner*—Stephen P. Avila
*Attorney, Agent, or Firm*—Alfred M. Walker

[57] ABSTRACT

A fire suppression system for a decorative tree, such as a Christmas tree, of the present invention wherein, disguised, for example, as a Christmas gift or incorporated as an integral part of the stand for the tree itself, there is provided a canister with a dry, substantially inert chemical, such as Halon, or similar fire suppressant substance, is disclosed. The fire suppressant substance is forced, e.g., by the application of pressure, when a heater smoke-sensitive sensor, released by a solenoid valve, is used to project the dispersant through a tubular plenum to a dispersant nozzle contained within, or as an integral part of, an ornament, e.g., a star, atop of the decorative tree. The flow of the fire suppressant fluid is preferably directed outward from a plurality of oval-shaped holes, preferably at least four such oval-shaped holes, which encircle a cylinder-type nozzle so as to provide dispersant to all directions surrounding the tree. The use of oval-shaped dispersing holes, or exit holes, for the fire suppressant substance has been discovered to have the beneficial effect of maximizing the flow of the fire suppressant substance by properly directing in a downward and outward direction thereby efficiently covering the tree in a time-effective manner.

2 Claims, 4 Drawing Sheets

FIRE SUPPRESSION SYSTEM FOR A DECORATIVE TREE

BACKGROUND OF THE INVENTION

1. Field of the Invention

The present invention relates generally to a fire suppression system for a decorative tree. More particularly, the present invention relates to a self-activating fire suppression system to extinguish fires that originate on decorative trees, such as, for example, Christmas trees.

As will be explained in greater detail hereinafter, a dry fire suppression chemical system, such as a tetrafluoroethylene polymer (e.g., commercially available from Allied Chemical Corp., U.S.A. and marketed under the trademark Halon), or similar substance, is directed under pressure when a fire starts. The dispersant is directed through a nozzle with novel exiting holes to maximize the spread of the dispersant over the entire area of the decorative tree and in at least the immediate area surrounding the tree.

In a preferred embodiment of the present invention, deflecting visors and/or veins may be provided in order to direct the flow of dispersant in a downward-like spiraling direction around the ignited tree.

2. Description of the Prior Art

Heretofore, fire extinguishers have been provided which have utilized a liquid held in a container wherein the container bursts as a result of a reaction to heat from a fire in order to release the liquid dispersant therein. Representative of the prior art are the fire extinguishing systems disclosed in U.S. Pat. Nos. 2,508,676; 2,522,020; 2,522,962; 2,682,310; 2,800,187; 2,871,952; 2,876,845; 3,132,695; 3,171,493; 3,773,111; 3,783,946; 4,709,763; 4,805,701; and, 4,830,114.

In the systems disclosed in the foregoing enumerated patents there is a need to provide an improved method of maximizing the flow of dispersant from an outlet in order to control the same and, further, to be able to shut down the electrical system for the tree so as to prevent further electrical shortages of the electrical wiring for the tree, as well as to aid in fighting such fire.

While the present invention has many uses, as further described below, it is particularly well suited for use as a fire suppressant system for Christmas trees and ornamentation. In connection with such use, it is desirable that fragmentation of burst canisters, as described in detail in the cited prior art, is prevented so that dangerous fragments, acting as projectiles, are not strewn upon persons in close proximity to the decorative tree upon ignition of the tree.

Moreover, it is beneficial to provide a directed flow of the dispersants in an outward, downward flowing direction so as to cover not only the Christmas tree, but any adjacent areas as well. Such benefit is not attained from the systems of the prior art.

As further explained below, in a preferred embodiment of the present invention, directional visors and/or veins are provided as to be deflect the flow of fluid in a spiral-like pattern to surround the Christmas tree and thereby maximize the efficient flow of dispersant upon the ignited Christmas tree.

At present, no apparatus exists for maximizing the flow of dispersant upon a decorative tree while, at the same time, shutting off the electrical system for the tree in order to prevent shortages of the wiring and further damage to the structure within which the Christmas tree or other ornaments are located.

SUMMARY OF THE INVENTION

It is, therefore, an object of the present invention to provide a fire suppression system for a decorative tree which maximizes the flow of dispersant upon a decorative tree when on fire.

It is a further object of the present invention to provide a fire suppression system for a decorative tree which will automatically shut down the electrical system for a tree when such tree catches fire.

It is, yet, a further object of the present invention to provide a fire suppression system for a decorative tree which will alert persons in the immediate area of the tree, when the tree is on fire, so that such persons may take the required safety measures.

It is a further object of the present invention to provide a fire suppression system for a decorative tree which will overcome the disadvantages inherent in the prior art, as heretofore described.

The foregoing and related objects are accomplished by the fire suppression system for a decorative tree, such as a Christmas tree, of the present invention wherein, disguised, for example, as a Christmas gift or incorporated as an integral part of the stand for the tree itself, there is provided a canister with a dry, substantially inert chemical, such as Halon, or similar fire suppressant substance.

As per the present invention, the fire suppressant substance is forced, e.g., by the application of pressure, when a heater smoke-sensitive sensor, released by a solenoid valve, is used to project the dispersant through a tubular plenum to a dispersant nozzle contained within, or as an integral part of, an ornament, e.g., a star, atop of the decorative tree.

The flow of the fire suppressant fluid is preferably directed outward from a plurality of oval-shaped holes, preferably at least four such oval-shaped holes, which encircle a cylinder-type nozzle so as to provide dispersant to all directions surrounding the tree. The use of oval-shaped dispersing holes, or exit holes, for the fire suppressant substance has been discovered to have the beneficial effect of maximizing the flow of the fire suppressant substance by properly directing in a downward and outward direction thereby efficiently covering the tree in a time-effective manner.

In a preferred embodiment of the present invention, deflectors and/or veins are further provided in order to further cause a spiraling flow of the dispersant around the decorative tree thereby further improving the coverage of the tree with the fire suppressant substance.

The use of oval-shaped dispersing holes is preferred inasmuch as it has been discovered that when circular dispersal holes are used, the dispersant tends to fan outward in a conical manner thereby wasting dispersant which flows immediately upward and then downward. The use of oval-shaped dispersing holes, and the dispersant nozzle, has been found to maximize the lateral flow of the dispersant thereby further projecting the same outwardly.

Other objects and features of the present invention will now be described in greater detail with reference being made to the accompanying drawing figures. It should, however, be understood that the drawing figures are intended to present a preferred embodiment of the present invention and are not intended as defining the limits and scope of the present invention.

BRIEF DESCRIPTION OF THE DRAWING

In the drawing, wherein in similar reference numerals denote similar features throughout the several views.

DETAILED DESCRIPTION OF THE DRAWING FIGURES

Figure 1:
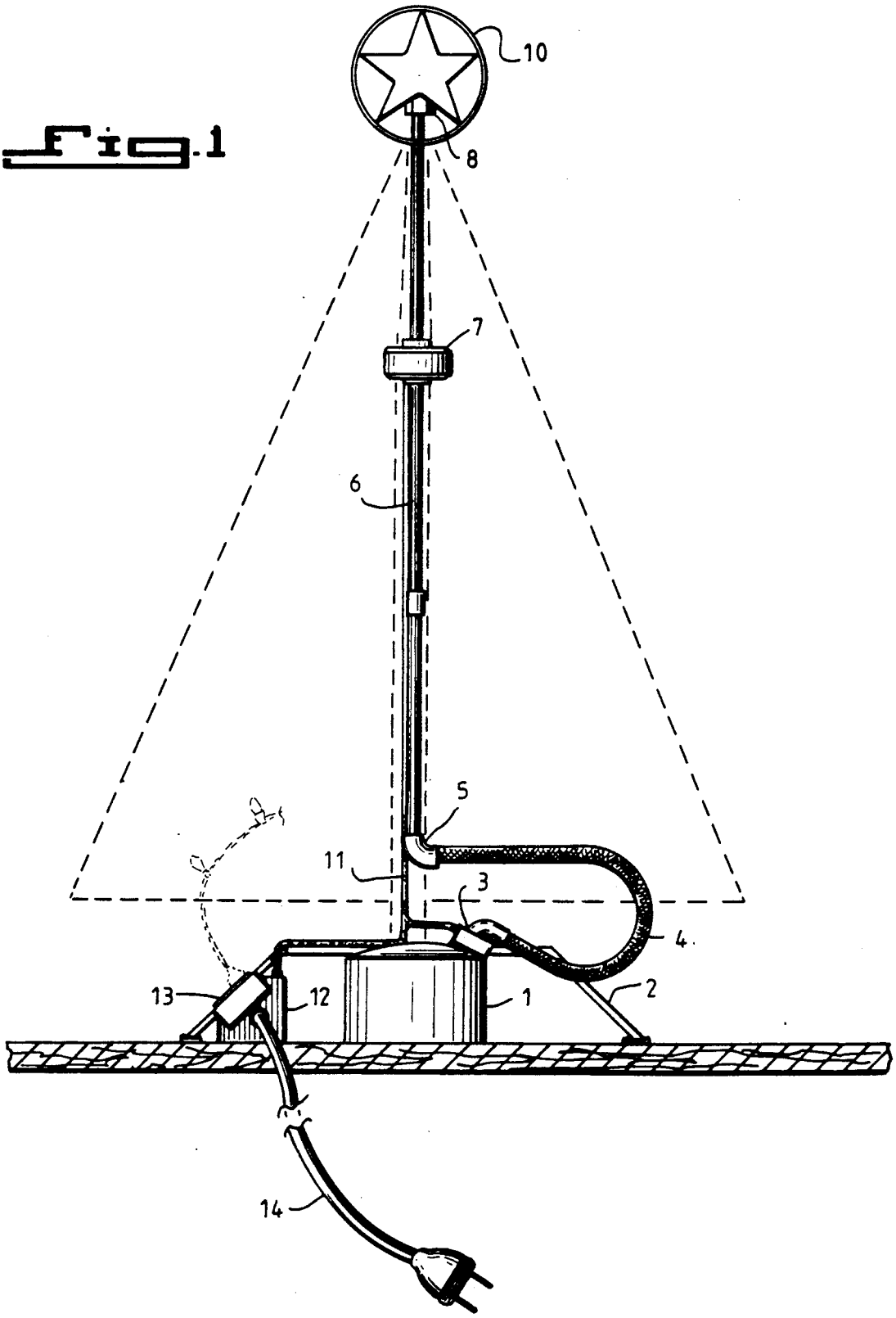
FIG. 1 is a side, elevational view of the fire suppression system for a decorative tree of the present invention, with the decorative tree outlined in this view.
Figure 2:
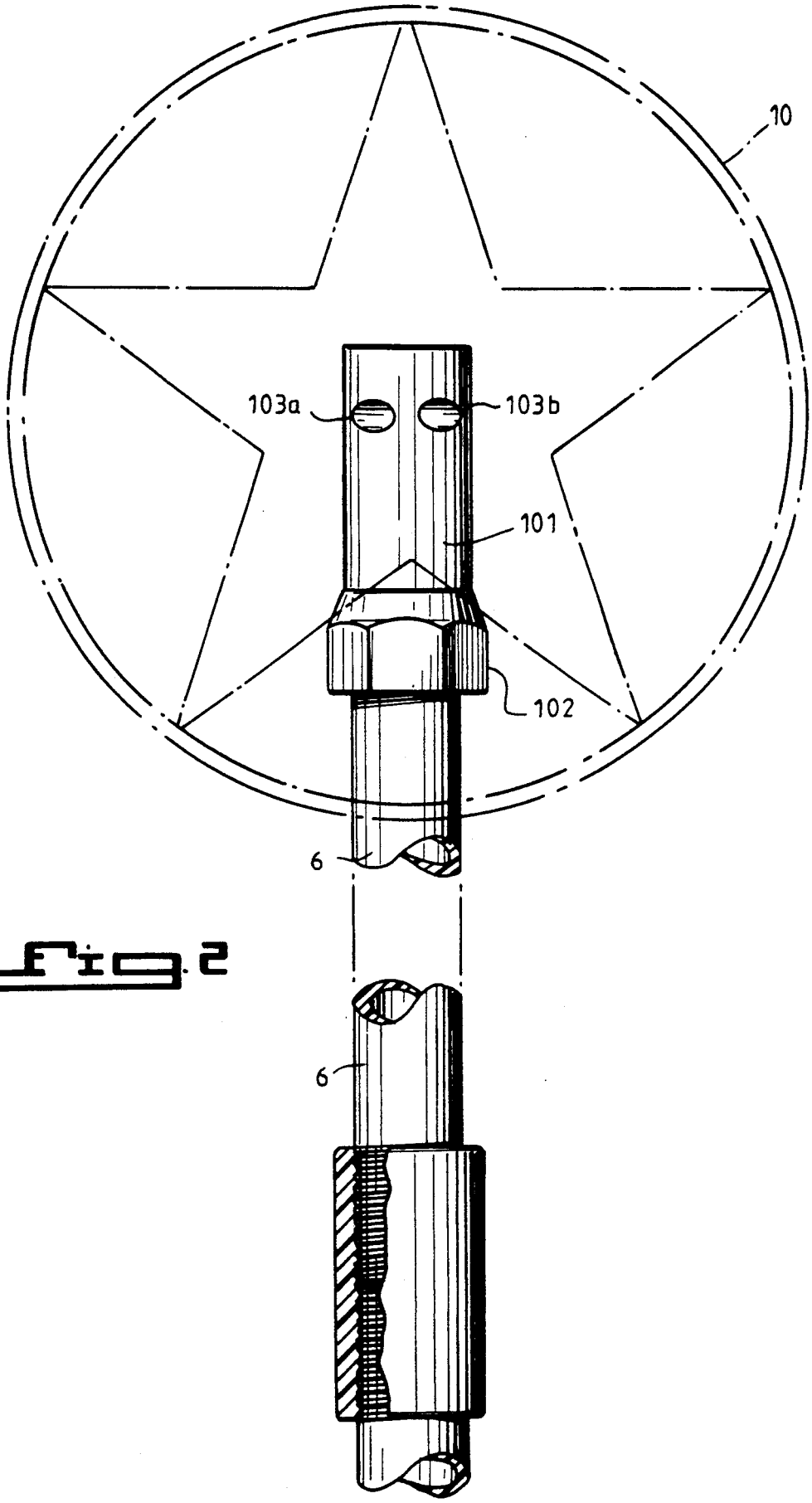
FIG. 2 is an enlarged, partial view, taken in elevation, of the dispersant nozzle of the present invention with said dispersant nozzle shown as being contained in an ornament atop of the decorative tree outline in FIG. 1.

Turning now, in detail, to an analysis of the drawing figures, in FIG. 1 there is shown a fire suppression system, in accordance with the present invention, in which a canister 1 contains Halon or other fire suppression substance. The canister 1 of the invention may either be provided as a separate unit or may be enclosed within the stand 2 of the decorative tree in which the trunk of the tree 2*a* is placed.

The Halon, for example, within the canister 1 is able to be dispersed through a solenoid valve 3 through a flexible hose 4 to a connecting joint 5 which, in turn, connects to a pipe conduit 6 which extends along the truck of the tree to its highest point.

Figure 5:
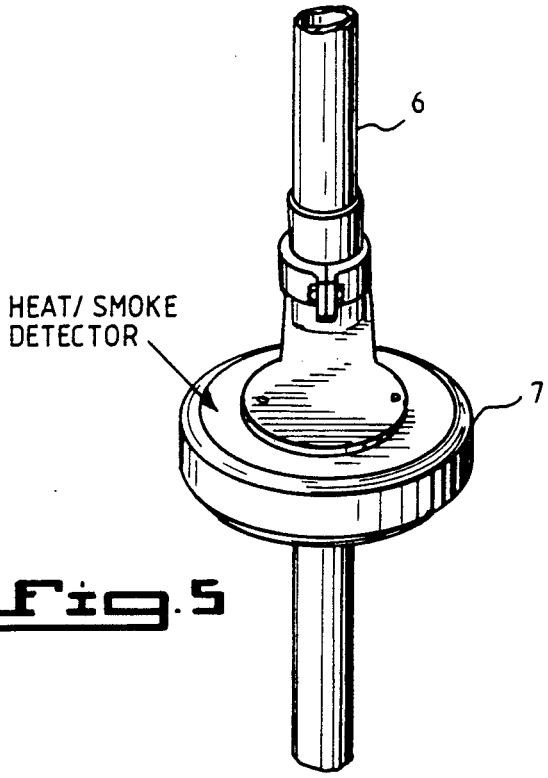
FIG. 5 is a partial, prospective view of a conduit for use as part of the present invention having a heat/smoke detector attached thereto; and, FIG. 6 is a partial view, taken in elevational, of the conduit and heat/smoke detector of FIG. 5 in combination with a solenoid valve for regulating the flow of the fire suppression substance through said conduit.
Figure 6:
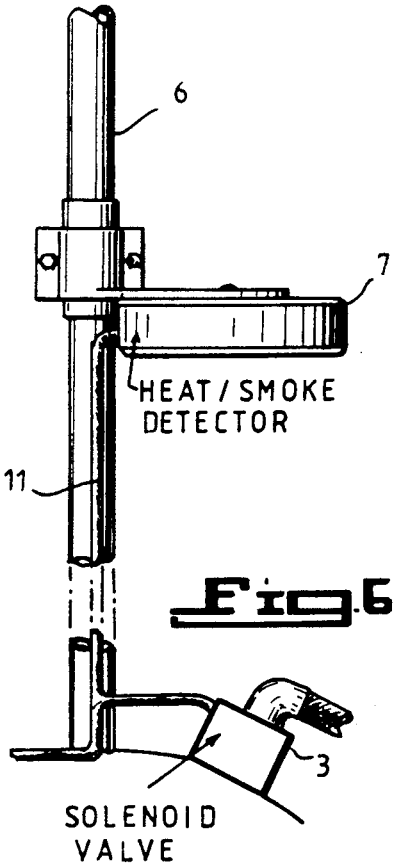

A heat sensor is further provided, and designated by the reference numeral 7, by strategically placing the same on the tree at, for example, the location shown in the drawing figures. The foregoing is specially illustrated in FIGS. 5 and 6 of the accompanying drawing figures.

One or more heat sensors may optionally be used in connection with the present invention and may include, for example, fusible links, smoke detectors or heat detectors. As a further embodiment, a string of heat/smoke detectors, resembling a string of Christmas lights, can be draped on the tree thereby avoiding under exposure of sensitivity to certain parts of the tree.

In the present invention pipe, or tubular, conduit 6 is preferably connected by a clamp 8 which, in turn, connects a four-hole nozzle with an ornament 10. It should be recognized that the precise number of holes for the nozzle may be varied, as appropriate. A ceiling hook (not shown) is further preferably provided in order to suspend the top of the tree, if necessary, from the ceiling.

In a preferred embodiment of the invention, detection device 7 is connected by control wire 11 which is connected to control box and light relay 12, which is electrically connected to a 120-volt outlet 13 for Christmas tree lights to optionally be connected thereto. A cord 14 extends from control box and light relay 12 to a standard outlet. When the heat sensor 7 detects heat or smoke, it activates control box and light relay 12 which, in turn, causes the dispersant Halon contained within canister 1 through solenoid valve 3, flexible hose 4, joint 5 and conduit 6, toward a dispersal element 10 in order to disperse the Halon from element 10 upon the tree.

At the same time, control box and light relay 12 causes a deactivation of the electrical system so as to prevent a shorting of the wires of the system. In a heat situation, for example, the electrical system can continue causing dangerous conditions for persons trying to control a fire. It is therefore preferable, if not a necessity, to shut down the electrical power to the decorative tree in order to prevent further damage and reduce the hazardous conditions existing at such a time.

Referring again to the drawing figures, as in common, the Christmas tree lights will be plugged into a multiple outlet 13. When an alarm condition arises, relay 12 will de-energize the lights on the tree, thereby preventing short circuits, which will eliminate, or at least substantially reduce, the likelihood of a fire spreading to other parts of the occupant's property.

Nozzle ornament 10 is preferably designed to maximize the flow of dispersant upon the decorative tree. A cylindrical nozzle head 101 is preferably connected by connecting means, such as a threaded screw 102, upon pipe conduit 6. Equally spaced oval shaped holes 103*a* and 103*b* are preferably placed around the circumference of tubular head 101 in order to permit the flow of fluid from the conduit 6 onto the tree. The holes 103*a*, 103*b*, 103*c* and 103*d* should, preferably, be spaced around the circumference of the nozzle head. Such openings are characterized by an oval shape wherein the horizontal diameter of the oval is greater than the vertical diameter of the oval. The purpose of this is to maximize the flow of fluid by preventing the loss of fluid from conventional circular holes, such as illustrated in FIG. 4.

Figure 4:
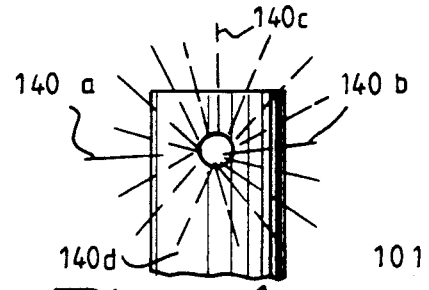
Fig. 4 (PRIOR ART)
FIG. 4 is an elevational view of the flow of the dispersing of the fire suppression substance from a circular dispersion hole.

As shown in FIG. 4, when viewing directly at the circular hole, the dispersant will tend to disperse, under pressure, in the directions as shown by the streams 140*a*, 140*b*, 140*c* and 140*d*. A good deal of dispersant, in this embodiment, is lost in an upward flow of streams 140*c* and the immediate down flow of streams 140*d*.

Figure 4A:
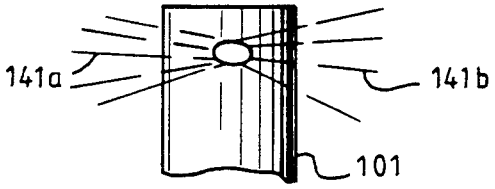
FIG. 4A is an elevational view of the flow of the dispersing of the fire suppression substance from an oval-shaped hole as the most preferred means for carrying out the present invention.

By contrast, as illustrated in FIG. 4A, the use of lateral horizontal oval shapes is preferred since this embodiment minimizes the immediate waste both in the upward and downward flow of the fire suppressant fluid and, thereby, maximizes the lateral flow of fluid through streams 141*a* and 141*b*. Because the fluid is dispersed laterally, it increases the coverage throughout the widest part of the tree at the bottom and beyond.

Figure 3:
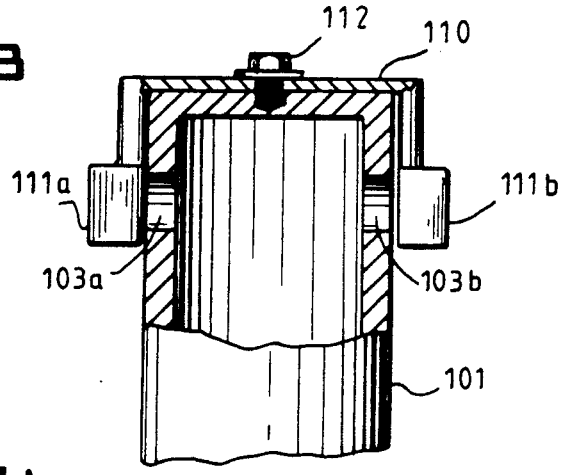
FIG. 3 is a partial view, taken in elevation, of a cap containing a plurality of deflectors to cover dispersant holes of the fire suppression system of FIG. 1.
Figure 3A:
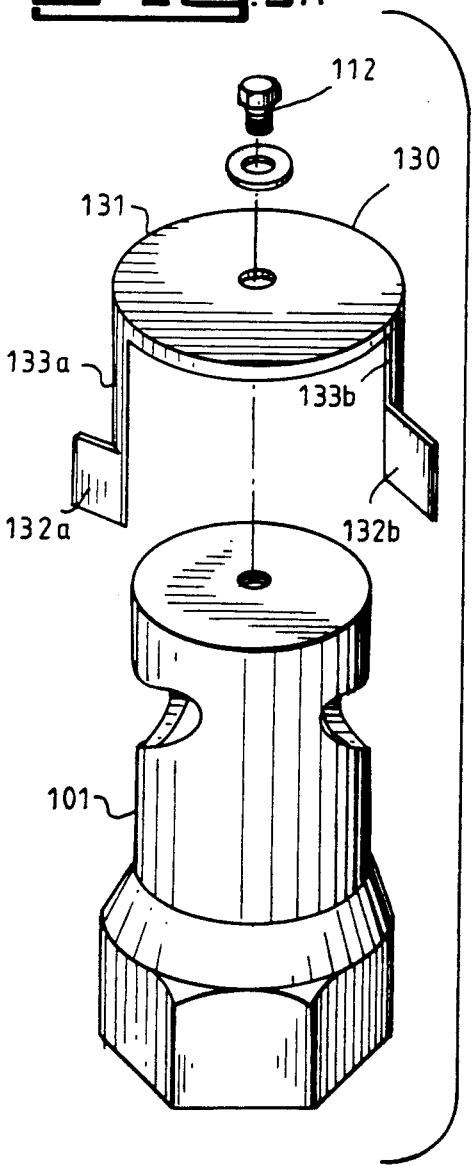
FIG. 3A is an enlarged, partially exploded perspective view of another preferred embodiment of the apparatus shown in FIG. 3.
Figure 3B:
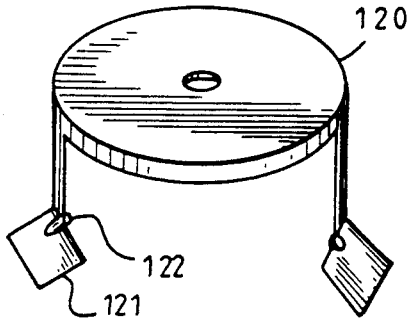
FIG. 3B is a perspective view of yet another preferred embodiment of the deflector apparatus shown in FIG. 3.
Figure 3C:
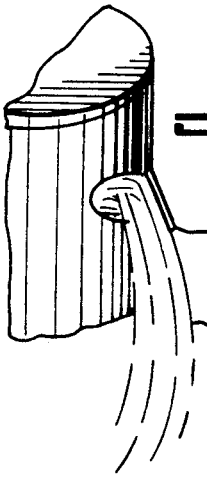
FIG. 3C is a partial view, taken in perspective, of a dispersing hole, of the present invention, expelling liquid.
Figure 3D:
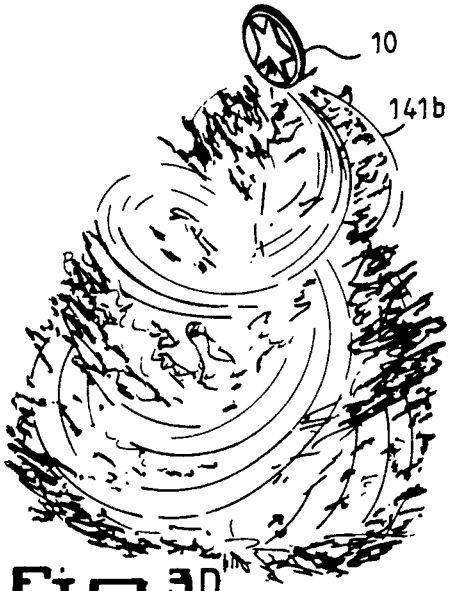
FIG. 3D is a perspective view of the flow of the fire suppression substance resulting from use of the fire suppression apparatus of the present invention.

Referring back to FIGS. 3–3D, a further embodiment of the present invention is shown in FIGS. 3, 3A and 3B wherein a plurality of deflectors are provided to further maximize a lateral flow of fluid by deflecting the lateral flow downward in a spiraling effect, as shown in FIGS. 3C and 3D. In FIG. 3, a cap 110 is provided which includes deflectors 111*a* and 111*b*, which are adjacent to the holes 103*a* and 103*b*. The cap 110 is connected by screw means 112 over nozzle head 101.

In a further preferred embodiment of the present invention, as illustrated in FIG. 3A, nozzle 101 is topped by a removable cap piece 130 having a top 131 and extending arms 133*a*, and 133*b*, from which deflectors 132 *a* and 132*b*, extend to deflect the fluid outwardly in a spiral manner. The cap 130 is placed atop of nozzle 101, as shown in the drawing figure.

As shown in FIG. 3B, in an alternative embodiment of the present invention, a cap 120 is provided wherein the deflectors 121 may be adjustable by joint means 122 upon nozzle 101.

It will be apparent to those of ordinary skill in the art that many modifications may be made to the present invention. For example, the type and number of heat/-smoke detectors may be varied. In addition, the shape of the dispersing holes for dispersing the fire suppression material may be varied, as well.

While only several embodiments of the present invention have been shown and described, it will be apparent to those of ordinary skill in the art that many modifications may be made to the present invention without departing from the spirit and scope thereof.

What is claimed is:

1. Apparatus for the suppression of a tree fire, upon a substantially conical shaped decorative tree comprising:

a canister capable of containing a fire suppression material;

a conduit leading from said canister for transporting therethrough the fire suppression material, said conduit having a plurality of stationary openings for permitting the exiting of the fire suppression material;

means for sensing the presence of heat or smoke; and, means for forcing the fire suppression material contained within said canister through said conduit to and through the plurality of openings of said conduit in order to combat a tree fire, said means for forcing being activated in response to said sensing means sensing the presence of heat or smoke;

means for directing said fire suppression material outward and downward over the substantially conical shaped decorative tree, said means being said plurality of openings being oval shaped and said openings having a horizontal diameter which is greater than a vertical diameter;

said means for sensing the presence of heater smoke includes a plurality of heat/smoke detectors which encircle a tree;

said means for forcing the fire suppression material contained within said canister through said conduit includes a solenoid valve;

an electrical control relay connected within said conduit, said electrical control relay being capable of deactivating electrical power for a tree.

2. The apparatus according to claim 1, further comprising a means for directing the exiting of said fire suppression material in an outward, downward spiraling manner over said substantially conical surface of said decorative tree, said means being a series of equally spaced stationary deflector veins about the top of said conduit for directing the fire suppression material exiting from said conduit.

* * * * *

UNITED STATES PATENT AND TRADEMARK OFFICE

CERTIFICATE OF CORRECTION

PATENT NO. : 5,018,586

DATED : May 28, 1991

INVENTOR(S) : Dennis Cawley and Richard Cawley

It is certified that error appears in the above-identified patent and that said Letters Patent is hereby corrected as shown below:

On the title page, in item [76], correct the inventors address to read as follows:

--255 Pine Street, Wollaston, Massachusetts 02170--.

Signed and Sealed this

Nineteenth Day of May, 1992

*Attest:*

DOUGLAS B. COMER

*Attesting Officer*

*Acting Commissioner of Patents and Trademarks*